United States Patent [19]

Kobayashi et al.

[11] 4,032,286

[45] June 28, 1977

[54] GAS COMBUSTION DEVICE WITH SAFETY DEVICE

[75] Inventors: Teruo Kobayashi, Kadoma; Kazumasa Yamamoto, Kawanishi, both of Japan

[73] Assignee: Matsushita Electric Industrial Co., Ltd., Kadoma, Japan

[22] Filed: Apr. 14, 1976

[21] Appl. No.: 676,816

[30] Foreign Application Priority Data

| | | |
|---|---|---|
| Apr. 18, 1975 | Japan | 50-47763 |
| May 20, 1975 | Japan | 50-60739 |
| Oct. 20, 1975 | Japan | 50-126690 |

[52] U.S. Cl. ..... 431/76; 73/26; 200/61.03; 431/80

[51] Int. Cl.[2] ..... F23N 5/24

[58] Field of Search ..... 431/75, 76, 80, 77; 200/61.03; 73/26

[56] References Cited

UNITED STATES PATENTS

| | | | |
|---|---|---|---|
| 2,352,143 | 6/1944 | Wills | 431/76 X |
| 3,307,613 | 3/1967 | Rexer | 431/76 |
| 3,354,931 | 11/1967 | Risse | 431/76 X |
| 3,610,792 | 10/1971 | Risse | 431/76 |

*Primary Examiner*—Edward G. Favors

*Attorney, Agent, or Firm*—Stevens, Davis, Miller & Mosher

[57] ABSTRACT

The present invention discloses a gas combustion device with a safety device including a combustible gas sensor which consists of an oxygen concentration cell comprising a calcined solid ion conductive electrolyte material and porous electrodes attached to both the major surfaces of the electrolyte material. The safety valve is operated in response to both outputs from the combustible gas sensor and from a pilot burner sensor including a thermocouple or the like. When the carbon monoxide content is increased, the safety valve is automatically closed, thereby interrupting the supply of gas and consequently preventing carbon monoxide poisoning and/or gas explosion.

6 Claims, 14 Drawing Figures

GAS COMBUSTION DEVICE WITH SAFETY DEVICE

The present invention relates to a gas combustion device or gas-fired equipment with a safety device capable of interrupting the gas supply immediately in response to the increase in carbon monoxide concentration.

A first object of the present inven is to provide a gas combustion device with a safety device including a combustible gas sensor which consists of a calcined solid ion conductive electrolyte material and porous electrodes attached to both major surfaces of the electrolyte material and a pilot burner sensor consisting of a thermocouple or the like, whereby a safety valve can be operated immediately in response to the increase in carbon monoxide concentration so as to interrupt the gas supply. According to the present invention, therefore, carbon monoxide poisoning and explosion can be prevented.

A second object of the present invention is to provide a gas combustion device with a safety device which can operate on any gas such as city-gas, propane gas, natural gas, and so on.

A third object of the present invention is to provide a gas combustion device with a safety device which can eliminate the use of a power supply such as dry cells or the like.

Today there is an increasing tendency of gas accidents such as explosions due to the leakage of propane gas, city-gas poisoning, and the like inspite of the extensive care and efforts, for preventing such accidents taken by gas equipment producers or suppliers. Under these circumstances, there has been a strong demand for establishing ordinances or regulations for forcing the manufacturers to attach a safety device to every gas combustion device or gas-fired equipment.

There has been proposed a safety device of the type which responds to the extinction of the flame of a pilot burner due to the wind, the pressure drop or the interruption of gas supply so that a safety valve is closed to prevent the leakage of fresh gas. This safety device can prevent the explosition caused by the leakage of propane gas. However, since the air-tightness of the rooms of the recently built buildings or houses is considerably improved, and there is a growing tendency for using gas combustion devices with much larger capacity, the insufficient supply of oxygen results in the incomplete combustion producing carbon monoxide poisoning. In order to prevent carbon monoxide poisoning, it is necessary to provide a safety device operable in response to the decrease in oxygen concentration below a critical level.

There has been developed a safety device of the type which can detect the insufficient supply of oxygen utilizing a phenomenon that the flame lifts up due to the decrease in oxygen. That is, when the supply of oxygen is not sufficient, the flame is elongated, and the combustion takes place at a place away from the tip of a burner. Therefore when a thermocouple is placed at the tip of the burner, the electromotive force (e.m.f.) created thereby drops below the normal level in case of the flame lift-up so that the oxygen deficiency may be detected. This detection method is very simple, its underlying principle is also simple and clear, and the cost of a safety device based on this principle is less. Therefore the safety devices of this type have been already widely used in practice particularly, in some European countries.

However, in some countries more than 15 kinds of gases are used as fuel, and the flame lift-ups are different with the kinds of gas used. For instance, in Japan the city gas supplies almost one half of the fuel gas demands. However, the flame lift-up can hardly occur in case of the city gas because it contains a relatively large amount of hydrogen and carbon monoxide. Therefore the reliable and dependable function of the flame lift-up type safety device cannot be expected at all.

Furthermore, the flame lift-up type safety devices cannot detect carbon monoxide produced as the result of the incomplete combustion by a main burner of a gas combustion device, because of its malfunction or erratic operation, though the combustion by a pilot burner is complete.

Therefore there has been a strong demand for a gas combustion device with a safety device which can satisfy the following requirements:

I. it can operate regardless of kinds or types of gas used;

II. it can prevent carbon monoxide poisoning in case of the incomplete combustion due to the unsufficient supply of oxygen; and III. it can prevent carbon monoxide poisoning in case of the abnormal combustion due to the malfunction of the combustion device.

The present invention therefore provides a gas combustion device with a safety device including a pilot burner sensor such as a thermocouple and a carbon monoxide sensor, whereby a safety valve can be automatically closed to interrupt the supply of gas when the incomplete combustion due to the insufficient supply of oxygen or abnormal combustion due to the malfunction or failure of the combustion device produces carbon monoxide in excess of a critical level hazardous to the health of men. The present invention may be applied to a boiler for supplying hot water to a bath tub or heating water in a bath tub, an instantaneous gas-fired hot water heater, a gas-fired oven and so on.

A gas combustion device with a safety device in accordance with the present invention basically consists of a carbon monoxide sensor capable of detecting the existence of carbon monoxide in the exhaust gases surrounding flames and creating an e.m.f., and a safety valve which can interrupt the supply of gas in response to the signals from the carbon monoxide sensor and from a pilot burner sensor.

FIRST EMBODIMENT, FIGS. 1 THROUGH 4

Figure 1:
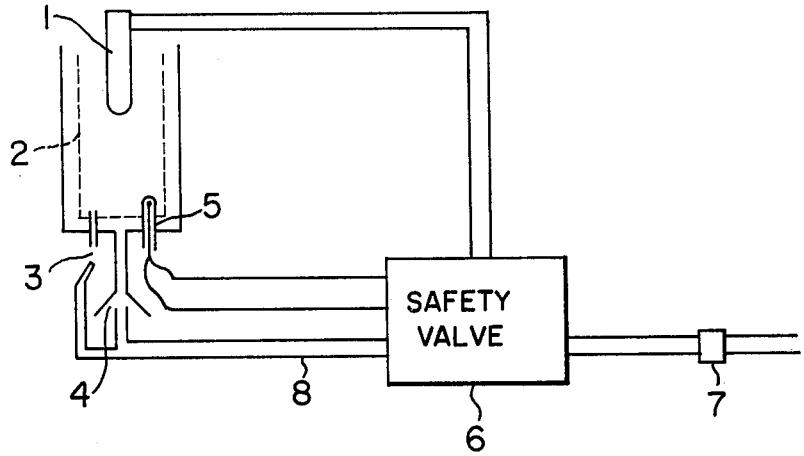
FIG. 1 is a schematic diagram of a first embodiment of the present invention.

In FIG. 1 there is shown a first embodiment of a gas combustion device in accordance with the present invention, comprising a carbon monoxide sensor 1, a main burner 2, a pilot burner 3, an inlet 4 for primary air, a pilot burner sensor 5 consisting of a thermocouple, a safety valve 6 and governer 7 each connected to a gas passage 8.

Figure 2:
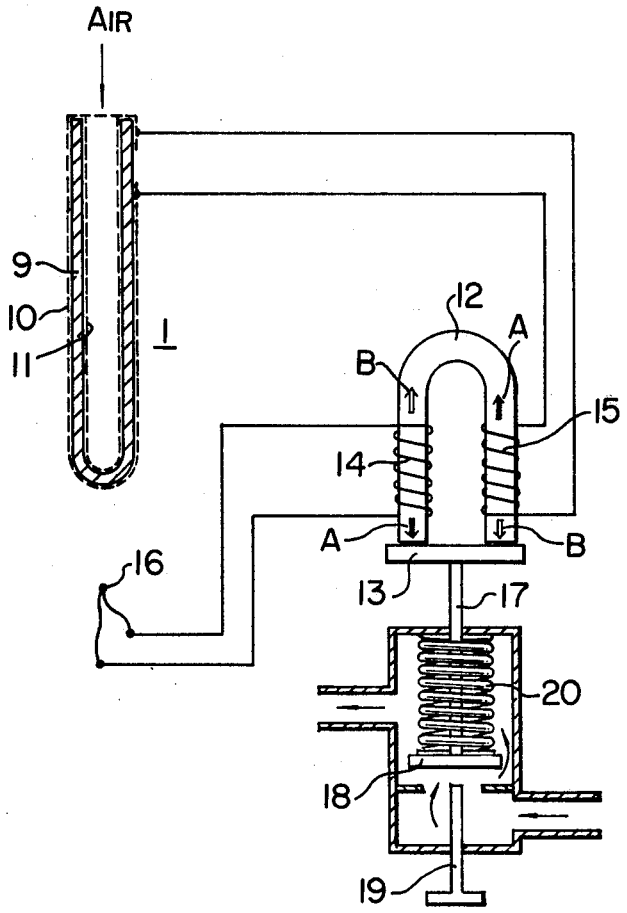
FIG. 2 is a schematic view, on enlarged scale, illustrating major components thereof.

In FIG. 2 there are shown major components of the first embodiment. The carbon monoxide sensor 1 comprises a hollow cylindrical calcined body 9 with its bottom closed and made of an ion-conductive solid electrolyte and porous platinum electrodes 10 and 11 attached to the outer and inner sufaces, respectively, of the calcined body 9. Therefore the carbon monoxide sensor or detector 1 according to the present invention is an oxygen concentration cell.

A first winding 14 mounted on one leg or pole of a horseshoe-shaped core 12 in the safety valve 6 is electrically connected to a thermocouple 16 in the pilot burner sensor 5 while a second winding 15 mounted on the other leg or pole is electrically connected to the carbon monoxide sensor 1. The magnetic flux is produced in the horseshoe-shaped core 12 in the direction indicated by the arrows A when the e.m.f. created in the thermocouple 16 flows the current through the first winding 14. On the other hand, when the e.m.f. created in the carbon monoxide sensor 1 flows the current through the second winding 15, the magnetic flux is produced in the direction indicated by the arrows B.

An armature 13 is attached to the upper end of a rod 17 extended through the top of a housing of the safety valve 6, and a disk 18 is attached to the lower end of the rod 17. A coiled spring 20 is fitted over the rod 17 between the disk 18 and the inner side of the top of the housing for normally biasing the disk 18 downwardly. A manually operable pushing rod 19 is extended into the housing through the bottom thereof for pushing the disk 18 upwardly.

Figure 3:
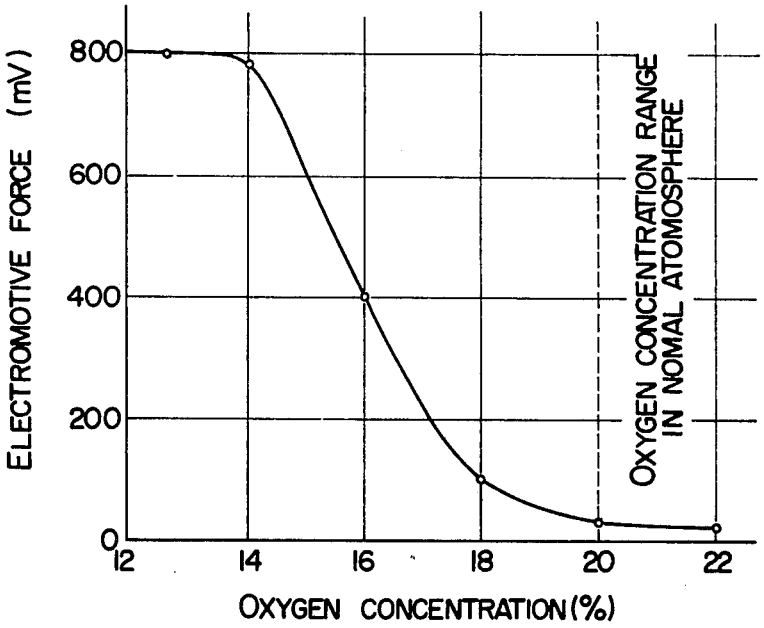
FIGS. 3 and 4 are graphs used for the explanation thereof.
Figure 4:
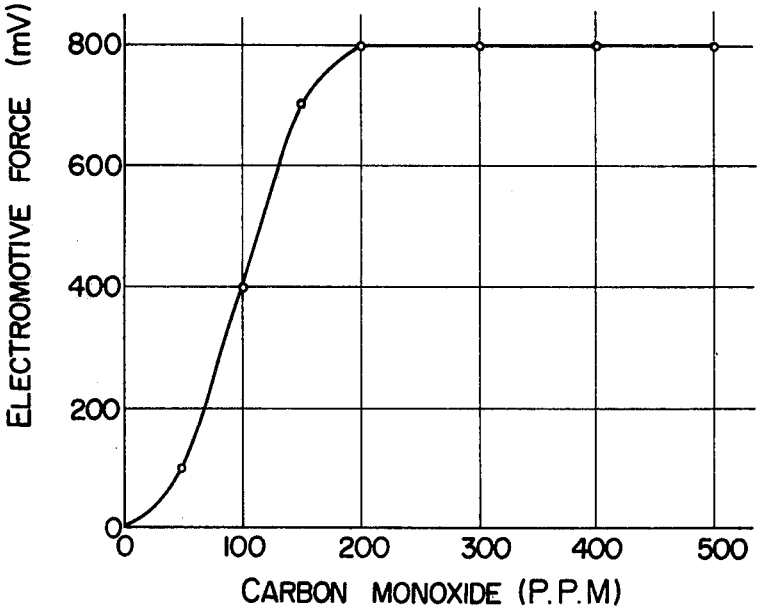

FIG. 3 is a graph illustrating the relation between the oxygen concentration (%) and the e.m.f. created by the carbon monoxide sensor 1 while FIG. 4 is a graph illustrating the relation between the carbon monoxide concentration (p.p.m.) and the e.m.f. created by the sensor 1.

Referring back to FIG. 2, when one pushes pushing rod 19 upwardly against the coiled spring 20, forcing the disk 18 upwardly, the gas flows through the safety valve in the direction indicated by the arrows to the main burner 2 and the pilot burner 3. To start the combustion, one ignites the pilot burner 3 for igniting the main burner 2. The gas combustion by the main burner 2 heats the thermocouple 16 in the pilot burner sensor 5 so that the e.m.f. created in the thermocouple flows the current through the first winding 14 and the magnetic flux is produced in the core 12 in the direction indicated by the arrows A. As a result, the core 12 attracts the armature 13 against the coiled spring 20, opening the safety valve 6 so that the gas is kept supplied to the main and pilot burners 2 and 3 as long as the main burner 2 keeps burning the gas.

However, when the carbon monoxide content in the exhaust gases around the flames of the main burner 2 should increase by some cause, the e.m.f. is created in the carbon monoxide sensor 1 as shown in FIGS. 3 and 4 so that the current flows through the second winding 15 and consequently the magnetic flux is produced in the direction opposite to that of the magnetic flux produced by the first winding 14. As a result, the attracting force of the core 12 drops below that of the coiled spring 20 so that the armature 13 is moved away from the core 12 under the force of the coiled spring 20 and consequently the disk 18 closes the gas passage in the safety valve 6. Therefore the gas supply to the main and pilot burners 2 and 3 is interrupted.

SECOND EMBODIMENTS, FIGS. 5 AND 6

Figure 5:
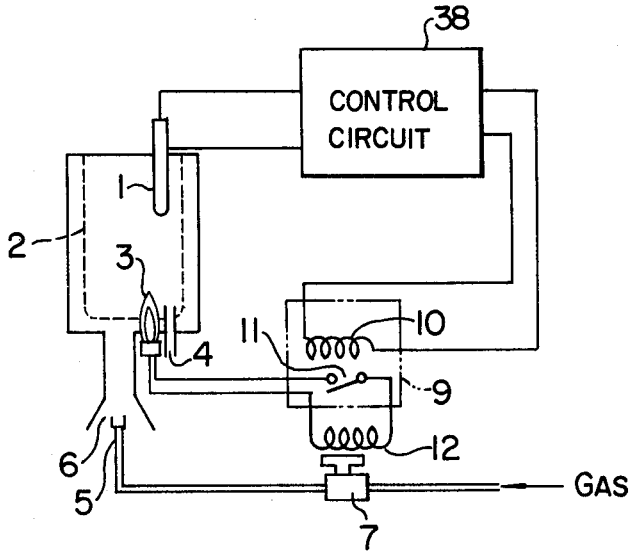
FIG. 5 is a schematic diagram of a second embodiment of the present invention.

In FIG. 5 there is shown a second embodiment of the present invention comprising a carbon monoxide sensor 1, a main burner 2, a pilot burner sensor 3 with a thermocouple, an opening through which a pilot burner is ignited, a gas supply nozzle 5, a primary air inlet 6, a safety valve 7, a control circuit 38 and a relay generally indicated by 9. The relay 9 consists of a coil or solenoid 10 and a switch or contact 11 which is opened when the solenoid 10 is energized in response to the output from the control circuit 8. A solenoid 12 of the safety valve 7 is connected through the switch or contact 11 to the pilot burner sensor 3.

Figure 6:
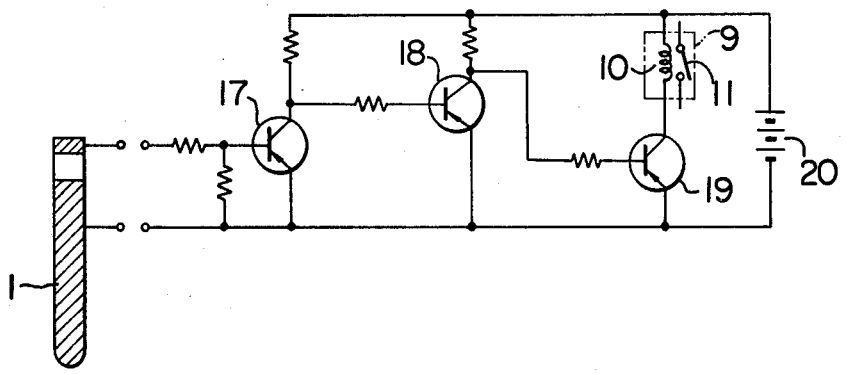
FIG. 6 is an electrical circuit diagram of a control circuit thereof.

FIG. 6 shows the diagram of the control circuit 8 comprising an amplifier section consisting of transistors 17 and 18 for amplifying the output from the carbon monoxide sensor 1, a switching transistor 19 and a power supply 20. In response to the on-off operation of the switching transistor 19, the relay 9 is controlled.

Referring back to FIG. 5, the mode of operation will be described. When the main burner 2 is ignited to start the gas combustion, the pilot burner sensor 3 is heated and consequently the e.m.f. is created in the thermocouple enclosed therein so that the solenoid 12 in the safety valve 7 is energized. As a result the safety valve 7 is kept opened so that the gas is supplied to the main burner 2.

As long as the oxygen content in the primary air introduced is normal; that is, between 20.5 to 21.5%, no e.m.f. is created in the carbon monoxide sensor 1. However when the oxygen content drops below 18.0% or the exhaust gases contain more than 100 p.p.m. CO due to the incomplete combustion, the e.m.f. is created in the carbon monoxide sensor 1. The maximum e.m.f. available may be 800 mV. The output from the sensor 1 is amplified by the control circuit 38, and the solenoid 10 in the relay 9 is energized so that the normally-closed contact 11 is opened and consequently the solenoid 12 in the safety valve 7 is de-energized. As a result, the safety valve 7 is closed to interrupt the supply of gas to the main burner 2. Thus, the carbon monoxide poisoning can be prevented.

When the room in which the combustion device is installed is sufficiently ventilated, the main burner may be ignited again.

When the small flame of the pilot burner is extinguished by some cause, the safety valve 7 is closed in response to the output from the pilot burner sensor 3.

As described above, the second embodiment of the present invention includes the pilot burner sensor and a CO poisoning preventive system which can interrupt the supply of gas to the burner in a very reliable manner in response to the CO content detected. Therefore the safe operation of gas combustion devices or gas-fired equipment can be assured.

It is to be understood that the second embodiment may be so modified that the relay 9 may be controlled directly in response to the output from the carbon monoxide sensor 1 instead of the output through the control circuit 38.

THIRD EMBODIMENT, FIGS. 8 THROUGH 10

Figure 7:
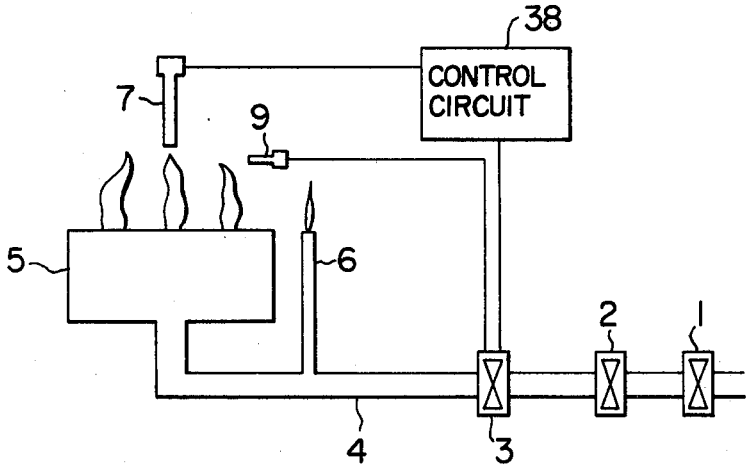
FIG. 7 is a schematic diagram of a third embodiment of the present invention.

In FIG. 7 there is schematically shown a third embodiment of the present invention comprising a main cock 1, a gas pressure regulator 2, a valve 3 (all of which are connected in a gas supply line 4), a main burner 5 and a pilot burner 6 both of which are connected to the gas supply line 4, a combustible gas sensor 7 disposed in the passage of the exhaust gases or combustion products adjacent to the flames from the main burner 5, a control circuit 38, and a pilot burner sensor 9 with a thermocouple enclosed therein. The valve mechanism 3 is controlled in response to both the outputs from the control circuit 8 and the pilot burner sensor 9.

Figure 8:
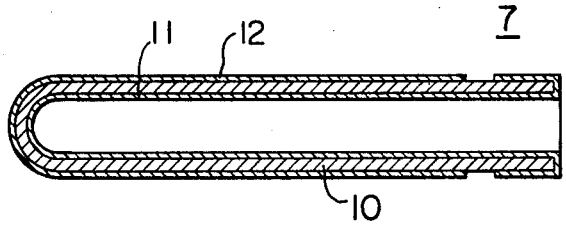
FIG. 8 is a sectional view of a combustible gas sensor thereof.

In FIG. 8 there is shown in cross section the combustible gas sensor 7 comprising a calcined body 10 in the form of a cylinder with one end closed and made of an ion-conductive solid electrolyte and porous electrodes 11 and 12 made of platinum or the like and attached to the inner and outer surfaces, respectively, of the calcined body 10. The sensor 7 therefore forms an oxygen concentration cell.

Figure 9:
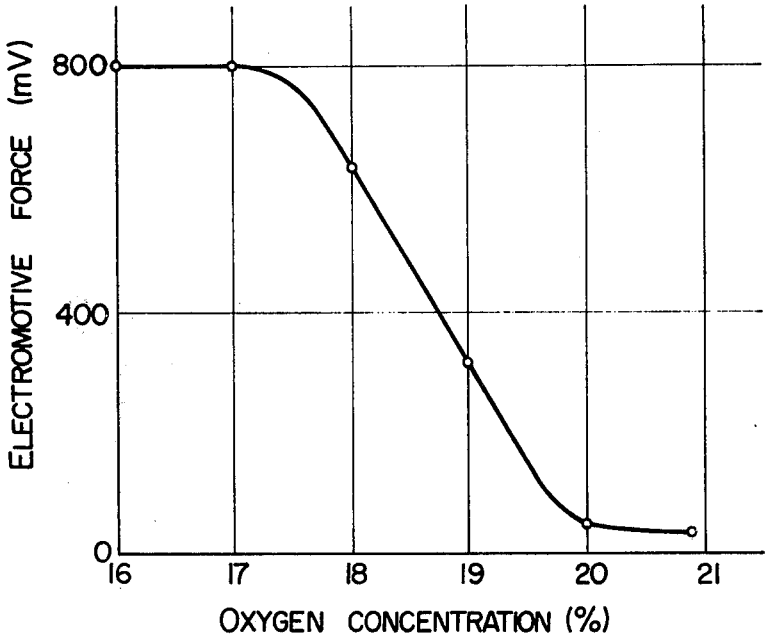
FIG. 9 is a graph used for the explanation thereof.

FIG. 9 shows the oxygen concentration (%) vs. e.m.f. characteristic curve of the sensor 7. The oxygen concentration or content (%) in the exhaust gases surrounding the flames of the main burner 5 is plotted along the abscissa while the e.m.f. (mV) created by the sensor 7 along the ordinate. The sensor 7 may create the maximum e.m.f. of 800 mV when the oxygen content drops below 20%.

Figure 10:
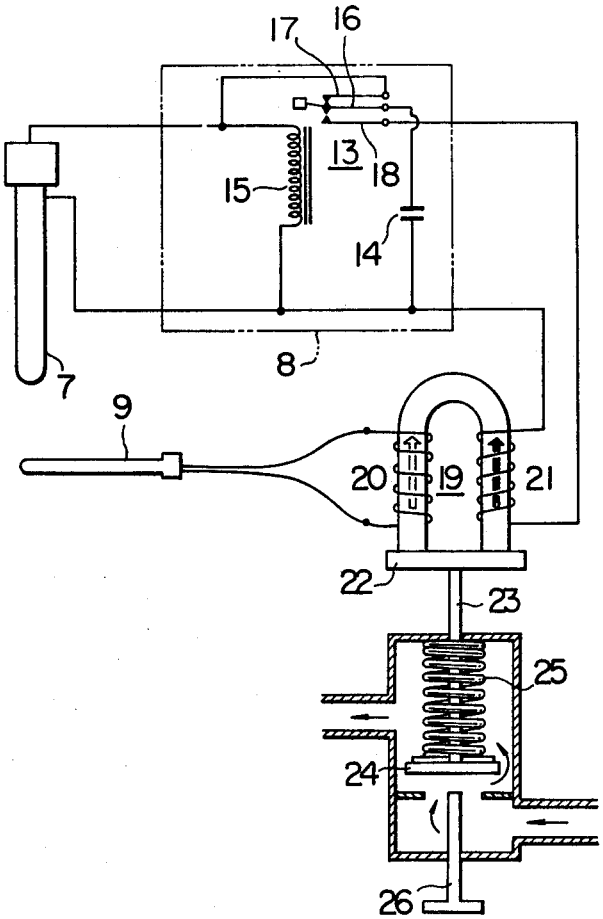
FIG. 10 is a schematic view illustrating major components of the third embodiment shown in FIG. 7.

In FIG. 10, there are shown major components of the third embodiment. The control circuit generally indicated by the reference numeral 38 consists a capacitor 14 and a relay (13), generally indicated by 13, which comprises of a solenoid 15, a movable contact 16, a normally-closed contact 17 and a normally-open contact 18.

A first winding 20 mounted on one leg or pole of a horseshoe shaped core of an electromagnet 19 is electrically connected to the thermocouple enclosed in the pilot burner sensor 9 while a second winding on the other leg or pole of the core is electrically connected to the control circuit 8. An armature 22 is attached to the top end of a rod 23 while a disk 24 is attached to the lower end thereof. A coiled spring 25 is mounted over the rod 23 so that the disk 24 may be normally biased downwardly. A manually operable pushing rod 26 is extended through the bottom of a housing of the valve mechanism 3 for engagement with the disk 24.

Still referring to FIG. 10, the mode of operation will be described. When one pushes the manually operable push rod 26 upwardly, forcing the disk 24 upwardly against the coiled spring 25, the gas flows in the direction indicated by the arrows to the main and pilot burners 5 and 6. To start the gas combustion, one ignites the pilot burner 6 which in turn ignites the main burner 5. As the gas combustion is started, the thermocouple in the pilot burner sensor 9 is heated so that the e.m.f. is created. As a result, the current flows through the solenoid 20 so that the electromagnet 19 is energized, attracting and holding the armature 22. That is, as long as the main burner 5 is burning the gas, the armature 22 is kept attracted by the electromagnet 19 against the force of the coil spring 25 so that the supply of gas to the main and pilot burners 5 and 6 may be continued.

When the carbon monoxide content in the exhaust gases surrounding the flames of the main burner 5 is increased by some cause, the e.m.f. is created in the combustible gas sensor 7 as shown in FIG. 9 and consequently the capacitor 14 is charged. When the carbon monoxide content increases in excess of a predetermined level and the current in excess of a predetermined level flows through the solenoid 15 accordingly, the movable contact 16 opens the normally closed contact 17 while closing the normally open contact 18 so that the capacitor 14 is discharged and consequently the current flows through the second winding 21 of the electromagnet 19. Since the second winding 21 produces the magnetic flux in the direction opposite to that of the magnetic flux produced by the first winding 20, the attracting force of the electromagnet 19 becomes weaker than the force of the coiled biase spring 25 so that the armature 22 with the rod 23 and the disk 24 is displaced downward and consequently the disk 24 closes the gas supply line. Therefore the supply of gas to the main and pilot burners 5 and 6 is interrupted.

As described above, the third embodiment in accordance with the present invention does not use a power supply such as a dry cell, but can automatically interrupt the gas supply line when the content of combustible gases such as carbon monoxide increases in excess of a predetermined level. Therefore the carbon monoxide poisoning can be completely prevented.

CARBON MONOXIDE SENSOR, FIGS. 11 THROUGH 14

As described above, the carbon monoxide sensor comprises a calcined body made of an solid ion conductive electrolyte material consisting of $ZrO_2$ or $ThO_2$ stabilized CaO or $Y_2O_3$, and porous electrodes attached to the surfaces of the calcined body. The sensor therefore forms an oxygen concentration cell. In this connection, it is preferable to fabricate the carbon monoxide sensors in a manner to be described hereinafter so that the lowest temperature at which the sensor can respond can be decreased further and the service life as well as the speed of response may be improved.

The surfaces of the calcined body made of an solid ion conductive electrolyte material are dense and smooth. According to the present invention, the rough surfaces are produced by a suitable mechanical method using a grinding wheel made of diamond, silicon carbide, alumina or the like or sand blasting, or by a suitable chemical method such as etching with hydrofluoric acid.

The porous electrodes with a high electrical conductivity are made by the vacuum evaporated coating of platinum, ion plating, coating of pasted platinum powder, or coating and reducing platinates such as platinum chloride dissolved in an ethanol solution and so on. The thin porous zirconia ceramic films coating the electrodes are prepared by the fusion-spray coating, or other ways one of which comprises steps of dipping the electrodes in sludges, drying and thereafter sintering, coating the electrodes with materials in the form of paste and thereafter subjecting the electrodes to sinter.

The porous electrodes coated with porous zirconia ceramic thin films are impregnated in an aqueous or ethanol solution of platinum-group compounds such as chloroplatinic acid, rhodium chloride or the like, and thereafter are sintered at high temperatures or heated in a hydrogen atmosphere thereby reducing the platinum-group compounds into platinum group metals, whereby the catalytic activity can be remarkably improved.

Figure 11:
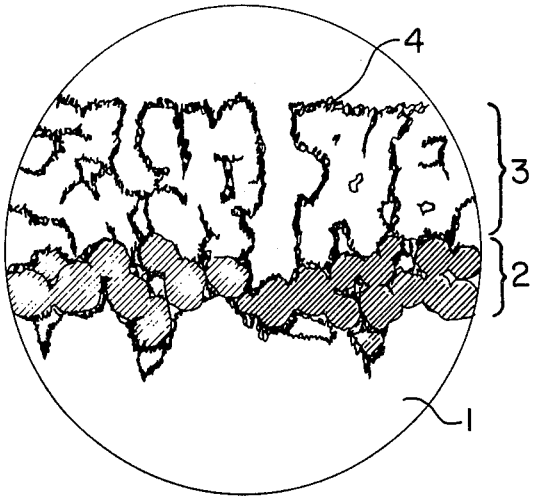
FIG. 11 is a schematic microscopic view of an electrode of a combustible gas sensor.
Figure 12:
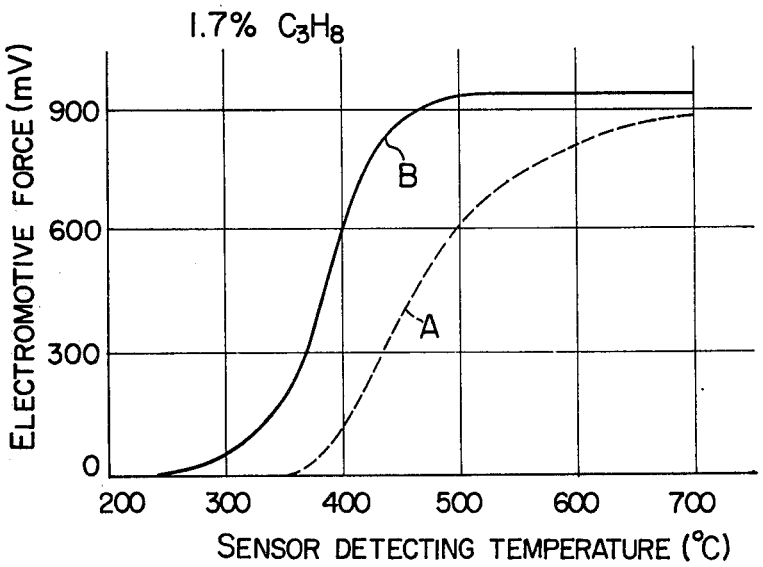
FIGS. 12, 13 and 14 are graphs used for the explanation thereof.

FIG. 11 is a schematic microscopic view of the sensor fabricated in the manner described above. In FIG. 11, reference numeral 1 denotes a calcined body made of an solid ion conductive electrolyte material; 2, a porous electrode; 3, stabilized zirconia ceramic; and 4, a thin film of a platinum group metal. Since the stabilized zirconia ceramic layer 3 with the thin film of a metal selected from the platinum group is coated over the porous electrode, the catalytic activity can be remarkably improved as indicated by the temperature vs. e.m.f. characteristic curve B in FIG. 12. The characteristic curve A of a conventional sensor is also shown in FIG. 12 for the sake of comparison.

Figure 13:
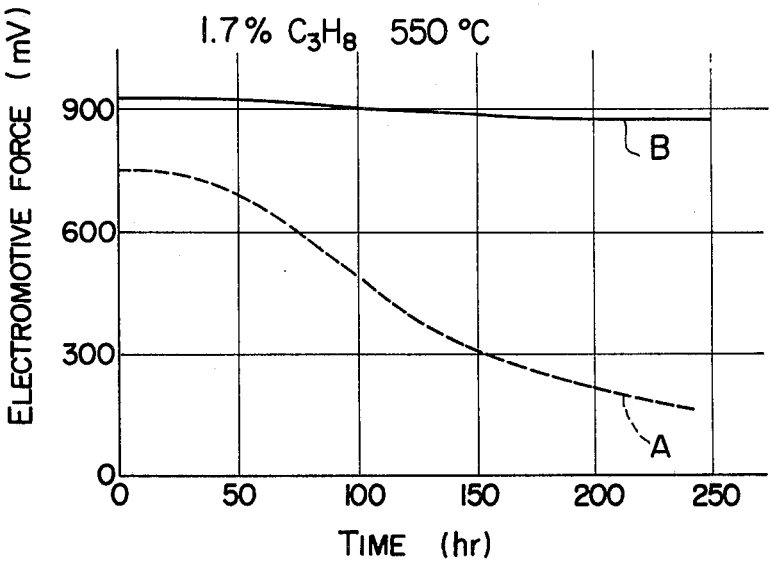

Since the porous electrode is coated with a thin oxide film, the exhaust gases may be prevented from directly impinging against the electrode so that the service life can be considerably improved as indicated by the curve B in FIG. 13. The broken-line curve A shown in FIG. 13 is the characteristic curve of a conventional sensor.

Figure 14:
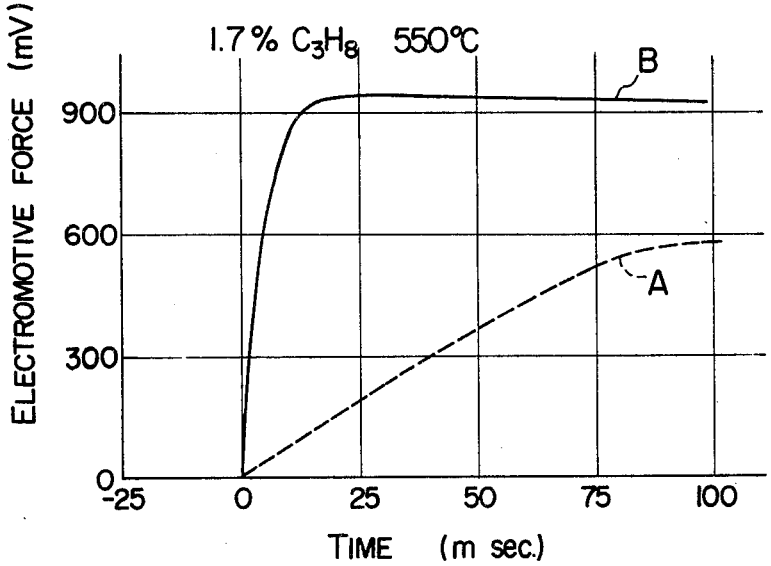

In the conventional sensors, the thin oxide film is coated over the electrode at the sacrifice of the speed of response. However, in accordance with the present invention, the thin film is formed by impregnating the electrode in a solution containing a metalic salt selected from the platinum group and then reducing. Therefore, the speed of response is also considerably improved as indicated by the characteristic curve B in FIG. 14. The broken-line curve A is the characteristic curve of a conventional sensor.

Instead of stabilized zirconia ceramic which coats the surfaces of the electrode, $\alpha$-alumina, silica or the like may be used. However, the former is most preferable from the standpoint of the thermal expansion and electric conduction. In the sensor in accordance with the present invention, the difference in thermal expansion between the base and the coating is zero because the coating consists of the same material as the base; that is, stabilized zirconia. Furthermore, the platinum electrode is annealed and the coefficient of thermal expansion of the platinum electrode is substantially equal to that of the stabilized zirconia ceramic layer, the separation of the latter will not occur. As to the electric conduction, since the electrode is coated with the stabilized zirconia, the electrical signal can immediately respond to the change in oxygen content or concentration over the coated surfaces of the electrode. That is, the speed of response is considerably improved. In addition, a high electric conduction can be obtained because of the increase in surface area of zirconia. The above advantages cannot be obtained by alumina coating.

The effects, features and advantages of the gas combustion devices with a safety device in accordance with the present invention may be summarized as follows:

I. The safety device can operate regardless of kinds of gas used such as city gas, propane gas, natural gas and so on.

II. The safety device can automatically close the safety valve when the oxygen content in the primary air decreases below 18%.

III. The safety device also functions when carbon monoxide is produced as a result of the incomplete combustion resulted from the malfunction of the combustion device even when the oxygen content in the primary air is normal.

IV. The carbon monoxide sensor can directly detect carbon monoxide in the exhaust gases at 500° to 800° C around the flames, the speed of response or detection is very fast.

V. Only a carbon monoxide sensor is further incorporated. The safety valve is actuable in response to both the outputs from the carbon monoxide sensor and the pilot burner sensor. These sensors will not require an external power supply. Therefore the considerable savings in cost can be attained.

What is claimed is:

1. A gas combustion device with a safety device characterized by the provision of
   a. a combustible gas sensor comprising a calcined body made of a solid ion conductive, electrolyte material, and porous electrodes attached to both surfaces of said calcined body,
   b. a pilot burner sensor including a thermocouple which creates an electromotive force (e.m.f.) in response to the detection of heat of combustion flames of said gas combustion device, and
   c. a safety valve connected in a gas supply line for said gas combustion device and operable in response to both the outputs from said combustible gas sensor and said pilot burner sensor.

2. A gas combustion device with a safety device as set forth in claim 1 characterized in that said safety valve is operated by the electromagnetic force produced by a horseshoe-shaped core carrying a first winding and a second winding which are wound in the opposite directions so that the magnetic fluxes produced by said first and second windings are opposite in direction, said first and second windings being electrically connected to said combustible gas sensor and said pilot burner sensor, respectively.

3. A gas combustion device with a safety device as set forth in claim 1 characterized in that, said safety device further comprises a relay, said combustible gas sensor is connected to a solenoid of said relay, and a solenoid for driving said safety valve is connected to said pilot burner sensor through a contact of said relay.

4. A gas combustion device with a safety device as set forth in claim 3 characterized in that an amplifier circuit for amplifying the output from said combustible gas sensor is connected between said combustible gas sensor and said relay.

5. A gas combustion device with a safety device as set forth in claim 2 characterized by the further provision of
   a. a capacitor for storing therein the output from said combustible gas sensor, and
   b. a relay responsive to the output from said combustible gas sensor, and adapted to turn over the connection of said capacitor to another winding on said horseshoe-shaped core.

6. A gas combustion device with a safety device as set forth in claim 1 characterized in that said porous electrodes of said combustible gas sensor are coated with a thin porous zirconia ceramic layer which in turn is coated on its surfaces with a thin layer of an element selected from the platinum group.

* * * * *